US011306710B2

(12) United States Patent
Ghodsi-Khameneh et al.

(10) Patent No.: US 11,306,710 B2
(45) Date of Patent: Apr. 19, 2022

(54) PUMP DEVICE

(71) Applicant: ebm-papst St. Georgen GmbH & Co. KG, St. Georgen (DE)

(72) Inventors: Hassan Ghodsi-Khameneh, Offenburg (DE); Daniel Hauer, Ortenberg (DE); Wolfgang Laufer, Aichhalden (DE); Markus Braxmaier, Bad Duerrheim (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 55 days.

(21) Appl. No.: 16/624,435

(22) PCT Filed: Jun. 12, 2018

(86) PCT No.: PCT/EP2018/065501
§ 371 (c)(1),
(2) Date: Dec. 19, 2019

(87) PCT Pub. No.: WO2019/015883
PCT Pub. Date: Jan. 24, 2019

(65) Prior Publication Data

US 2020/0132065 A1 Apr. 30, 2020

(30) Foreign Application Priority Data

Jul. 21, 2017 (DE) ..... 102017116468.5

(51) Int. Cl.
*F04B 43/12* (2006.01)
*F01C 5/02* (2006.01)
*F04C 5/00* (2006.01)

(52) U.S. Cl.
CPC ..... *F04B 43/123* (2013.01); *F01C 5/02* (2013.01); *F04C 5/00* (2013.01); *F04C 2210/1083* (2013.01); *F04C 2240/30* (2013.01)

(58) Field of Classification Search
CPC ..... F04B 43/12; F04B 43/08; F04B 43/123; F04B 43/14; F04B 43/10; F01C 5/02; F04C 5/00; F04C 2240/30
See application file for complete search history.

(56) References Cited

U.S. PATENT DOCUMENTS 2,544,628 A * 3/1951 Copping ..... F04B 43/14 418/45
3,408,947 A * 11/1968 McMillan ..... F04C 5/00 418/45

(Continued)

FOREIGN PATENT DOCUMENTS

DE 102015106610 A1 11/2016
DE 102015106613 A1 11/2016
DE 102015106613 A1 * 11/2016 ..... F04C 5/00

OTHER PUBLICATIONS

International Search Report dated Sep. 26, 2018, which issued in corresponding PCT Patent Application No. PCT/EP2018/065501.

*Primary Examiner* — Nathan C Zollinger
(74) *Attorney, Agent, or Firm* — Dickinson Wright PLLC

(57) ABSTRACT

A pump device (10) for pumping a fluid, having a hydraulic enclosure (12) that comprises an annular section, a pump ring (14) that is deformable and which defines an annular pump chamber at least in certain regions, a pump ring carrier (16) that is solidly connected to the pump ring (14), a first connector and a second connector, which first connector and which second connector are in fluid communication with the pump chamber, wherein the pump device (10) is set up in such a way that at least one measure influences a parking position of an eccentric (18) such that said parking position is preferred in the region of a clamping member (114), the measure being selected from: a) at least one recess in the hydraulic housing, which recess locally widens the chamber for the pump ring (14) in the axial direction, b) a geometry (Continued)

Figure 1:
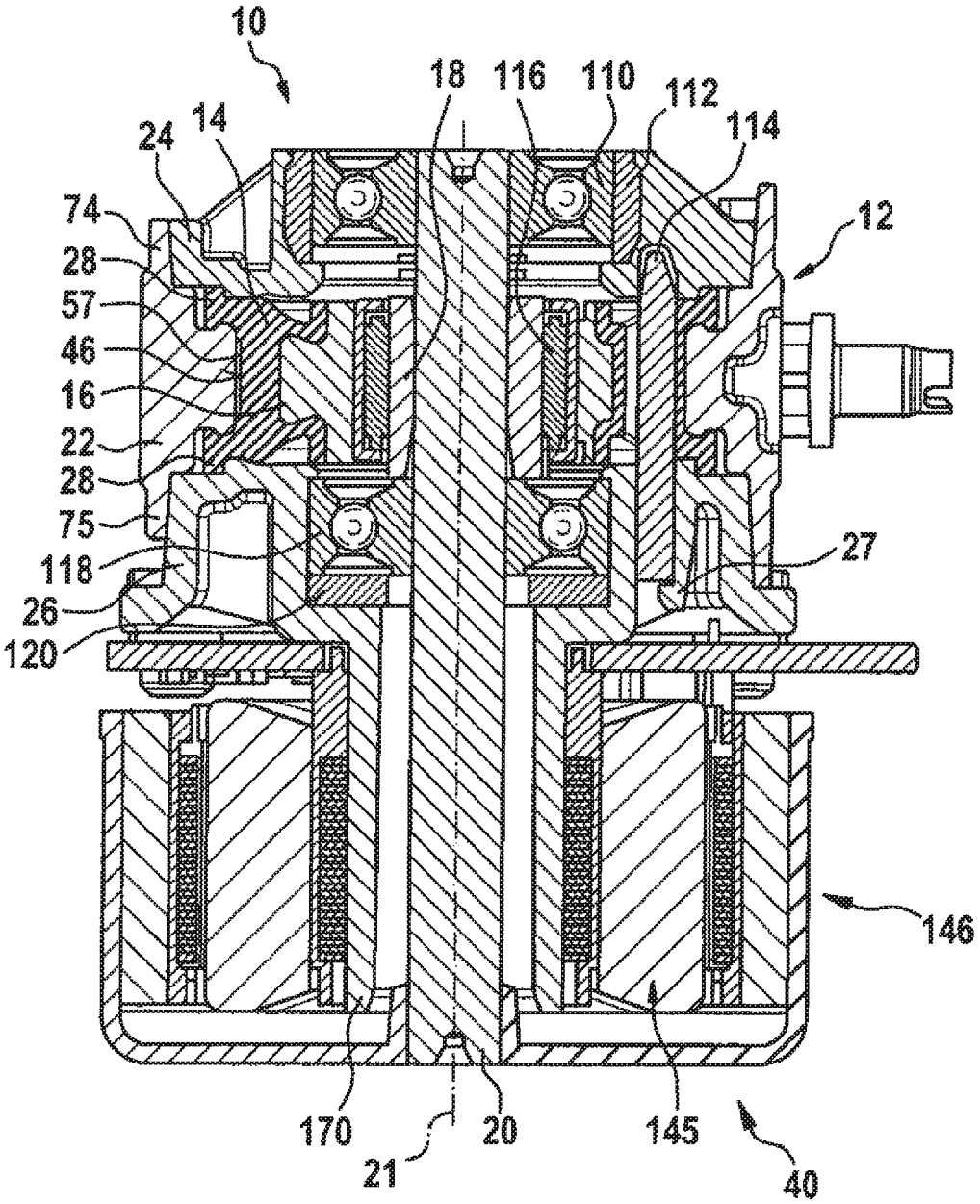

of the pump ring carrier (16), in which the pump ring carrier (16) has an enlarged diameter on its inner side facing the eccentric (18) in the angular region of the clamping member (114), and c) a geometric configuration of the pump ring (14), which, in the non-installed state of the pump ring (14), provides in one region at least a reduced strength of the pump ring (14), said region being in the clamping member region in the installed state of the pump ring (14), resulting in a reduced axial pressing action of the pump ring (14) in the clamping member region.

12 Claims, 6 Drawing Sheets

(56) References Cited

U.S. PATENT DOCUMENTS

| | | | | |
|---|---|---|---|---|
| 4,332,534 | A * | 6/1982 | Becker | F04B 43/14<br>418/153 |
| 5,006,049 | A * | 4/1991 | von der Heyde | F04C 5/00<br>417/476 |
| 9,453,507 | B2 * | 9/2016 | Ghodsi-Kameneh | F04B 13/00 |
| 9,752,484 | B2 * | 9/2017 | Bruck | F01N 9/00 |
| 10,072,547 | B2 * | 9/2018 | Hodgson | F04C 15/06 |
| 10,240,503 | B2 * | 3/2019 | Hodgson | F04B 53/16 |
| 10,294,937 | B2 * | 5/2019 | Hodgson | F01N 3/206 |
| 10,570,738 | B2 * | 2/2020 | Braxmaier | F01C 5/02 |
| 10,677,059 | B2 * | 6/2020 | Ghodsi-Khameneh | F04C 5/00 |
| 2014/0017094 | A1 * | 1/2014 | Ghodsi-Kameneh | F04C 15/0003<br>417/44.1 |

* cited by examiner

PUMP DEVICE

The invention relates to a pump device for pumping a liquid.

A pump device or pump is understood here to mean a machine for conveying liquids. These also include mixtures of liquids and solids, pastes and liquids with a low gaseous component. During the operation of the pump device, the drive power is converted into the kinetic energy of the transported liquid.

The illustrated pump device is also referred to as orbital pump, rotary pump, propeller pump, diaphragm pump, membrane pump, or peristaltic pump.

The pump device may be used to conduct a liquid from a reservoir, for instance a tank, to a desired environment, for instance into an exhaust tract of an internal combustion engine.

From publication DE 10 2013 104 245 A1, a pump device is known, formed as an orbital pump, featuring a pump enclosure with at least one intake and at least one outlet, wherein on the pump enclosure, an eccentric is arranged rotatably relative to the pump enclosure. An electrical drive is provided for moving the eccentric. Between the eccentric and the pump enclosure, a deformable membrane is located, which, together with the pump enclosure, delimits a conveyance path from the at least one intake on the at least one outlet, and which forms at least one seal of the conveyance path. The at least one seal can be shifted by a movement of the eccentric for conveyance along the conveyance path.

Publication WO 2012/126544 A1 describes a dosage system for dosing a liquid by means of a pump device having an eccentric drive that can be driven by means of an electric motor. The pump device, which has two transportation directions, features a pump ring and a stationary ring, the latter being arranged relative to the pump ring and on the eccentric drive, such that a pump chamber is formed between the stationary ring and the pump ring, which changes its shape when the electric motor is rotated in order convey a dosed liquid through the pump chamber. The operating principle of an orbital pump is described in the document.

It must be noted that arbitrary settings of the eccentric can lead to unwanted side effects. These are, for instance, a variation of the conveyance properties, or leakages due to interior leaks at a parking position of 180°+−90°.

Against this background, it is a task of the present invention to provide a new pump capable of supporting the parking of the cylinder in a desired position in order to avoid the aforementioned disadvantages.

Proposed is a pump device for pumping a fluid, having a hydraulic enclosure that comprises an annular section, a pump ring that is deformable and which defines an annular pump chamber at least in certain regions, a pump ring carrier that is solidly connected to the pump ring, a first connector and a second connector, which first connector and which second connector are in fluid communication with the pump chamber, an eccentric, which must be driven by a shaft defining an axial and a radial direction in such a manner that the eccentric is rotatable relative to the hydraulic enclosure, the eccentric being arranged in the pump device in such a manner that the eccentric, depending on the actual rotating position of the eccentric, deforms the pump ring in such a manner that the pump ring is pressed at least in certain regions against the annular section in order to convey the fluid along the pump chamber from the first connector to the second connector, depending on the actual rotating position of the eccentric, by rotating the eccentric, and a clamping member designed to statically press the pump ring in a clamping member region against the annular section of the hydraulic enclosure.

The proposed pump device is designed such that by means of at least one measure, a parking position of the eccentric is impacted such that in the area of the clamping member it is preferred. This measure is selected from:

a) at least one recess in the hydraulic enclosure, which locally extends the space for the pump ring in the axial direction in the clamping member region, b) a geometry of the pump ring carrier, which is such that the pump ring carrier has an enlarged diameter on its interior side facing the eccentric in the angular region of the clamping member, and c) a geometric configuration of the pump ring, which provides at least a reduced strength of the pump ring in one region in the non-installed state of the pump ring, this region being in the clamping member region in the installed state of the pump ring, such that it results in a reduced axial pressing action of the pump ring in the clamping member region.

The proposed pump device is therefore designed such that the positioning of the eccentric after parking is affected, and that therefore a preferred parking position can be reached by means of one or more of the stated measures. The preferred parking position is reached when the eccentric is in the area of the clamping member, in other words, when the eccentric section of the eccentric points in the direction of the clamping member region. This parking position avoids the aforementioned disadvantages, and has the additional advantage that during starting, the eccentric can be moved more easily out of it. Thus, a trial run resulted in a reduced required torque for starting the eccentric of 54 mNm, as compared to 68 mNm without the described measures.

Measure a) accomplishes that due to the at least one recess in the hydraulic enclosure into which the pump ring extends, it can be compressed more easily in this region.

Measure b) accomplishes that due to the enlarged diameter of the pump ring carrier in the angular region of the clamping member, the eccentric can be rotated in this region with a smaller expenditure of force.

Measure c) accomplishes that the geometric configuration of the pump ring results in a reduced axial pressing action of the pump ring in the clamping member region, such that it can be compressed more easily in this region.

The pump chamber, which is in fluid communication with the first connector and with the second connector, is typically formed between the pump chamber and the annular section. In particular, it is provided that the pump chamber in which the fluid is moving is formed between the pump ring and the annular section of the pump device, such that a movement of the pump ring or a compression of the pump ring in certain regions seals the pump chamber in certain regions, and the fluid is conveyed out of the respective compressed region, and as a result, is moved through the pump chamber.

In one embodiment, the clamping member is designed to statically press at least a portion of the pump ring against the annular section in the clamping member region between the first connector and the second connector, and as a result, to reduce or prevent a flow of fluid between the first connector and the second connector via the clamping member region.

In one embodiment, the measure a) provides that the at least one recess in the hydraulic enclosure is graded. In another embodiment, the recess in the hydraulic enclosure is continuous. This means that the recess, in a sectional view, may either have a graded outline or graded contours, or a continuous outline or continuous contours. Naturally, other outlines or contours, specifically also including combinations of graded and continuous outlines, are conceivable as well.

Furthermore, measure a) may provide that the at least one recess is provided in a convex area of the hydraulic enclosure.

In one embodiment, measure a) provides that two recesses are provided, provided opposite in the axial direction in the hydraulic enclosure. In this case, the pump ring extends axially opposite in the two recesses, and may be compressed particularly easily.

Furthermore, measure b) may provide for the pump ring carrier to feature an enlarged diameter on its outer side, facing away from the eccentric, in the angular region of the clamping member. This, in combination with the enlarged diameter of the pump ring carrier to its interior side facing the eccentric, in the angular region of the clamping member, allows for a simplified production of the pump ring carrier. In this case, it must be observed that the pump ring in the clamping member region should also have a reduced strength.

In a further embodiment, measure c) provides for the pump ring to be embodied in such a manner that in the non-installed state it features an asymmetrical mound.

According to one possible embodiment, a pump ring carrier is connected, in particular solidly connected, with the pump ring. Furthermore, the pump ring carrier may feature at least one pump ring carrier recess in the circumferential region of the at least one recess of the pump ring feature, in which the clamping member is arranged. The pump ring carrier recess allows for affecting the rigidity of the pump ring or of the system in its entirety in the clamping member region. This makes it possible for the eccentric to be better rotated past the clamping member region.

In addition, a pump ring fora pump device is proposed, in particular fora pump device of the aforementioned type, wherein the pump ring provides for a reduced strength of the pump ring in one region, this region being in the clamping member region in the installed state of the pump ring, resulting in a reduced axial pressing action of the pump ring in the clamping member region.

This pump ring may feature an asymmetrical mound.

Additional advantages and embodiments of the invention follow from the description and from the enclosed drawings.

It should be understood that the aforementioned features and those mentioned hereinafter can be used not only in the respective specified combination, but also in other combinations or on their own, without thereby exceeding the scope of the present invention.

Figure 2:
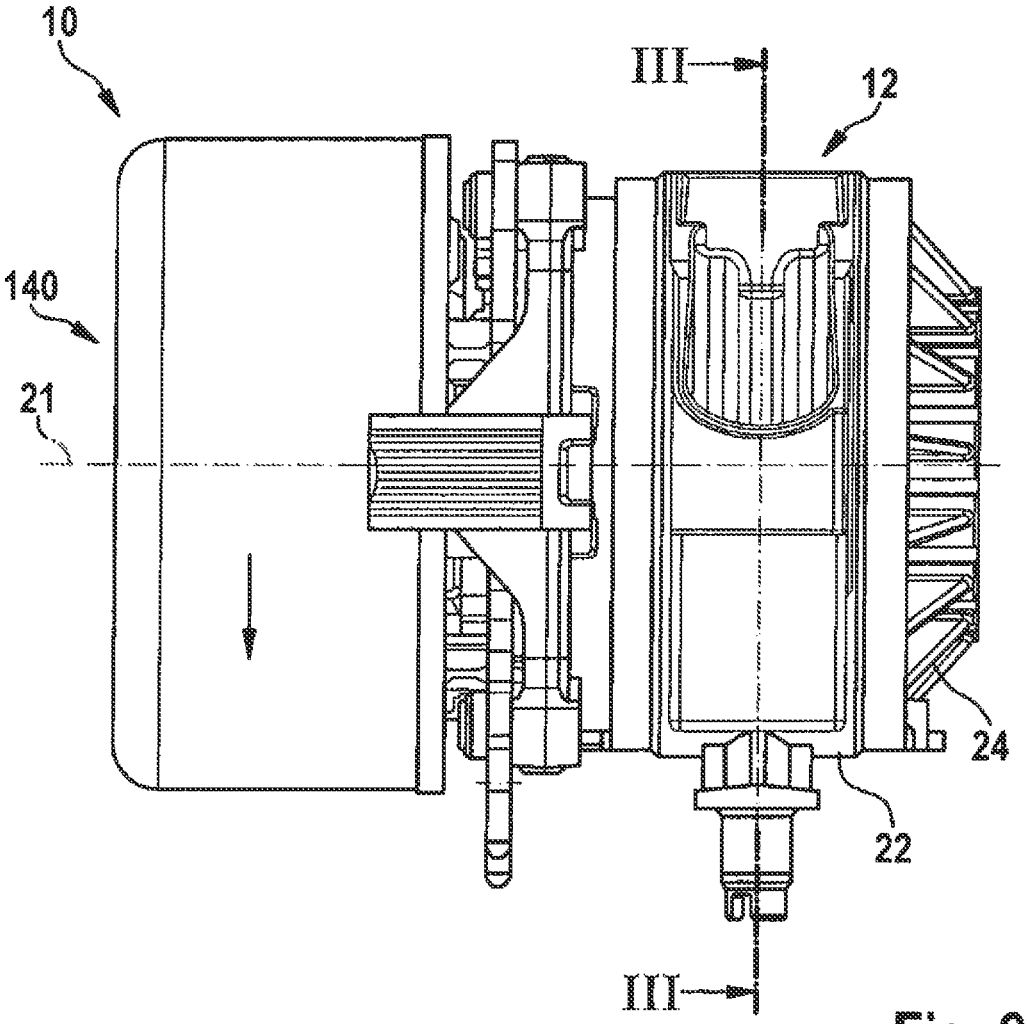
Figure 3:
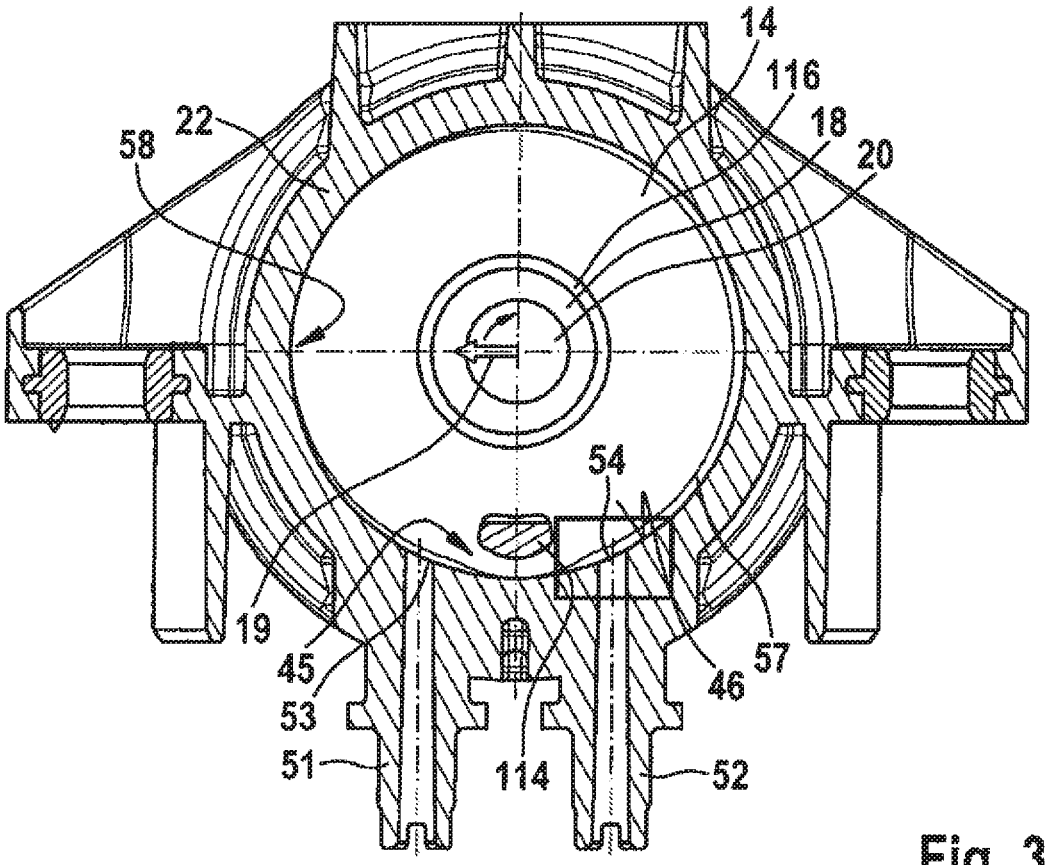
Figure 4:
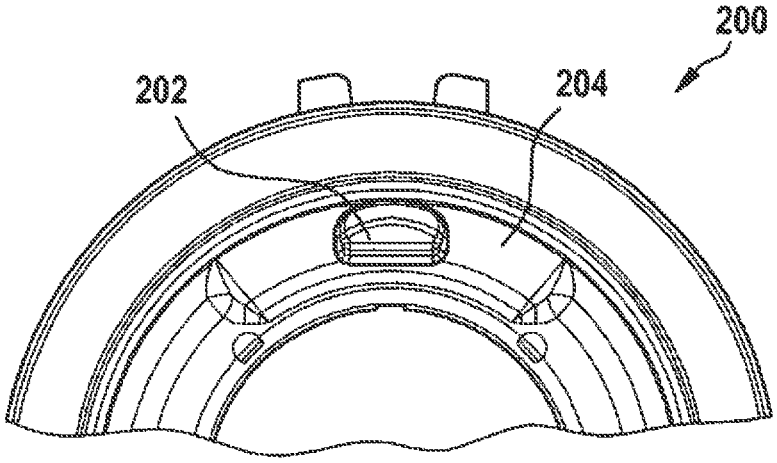
Figure 5:
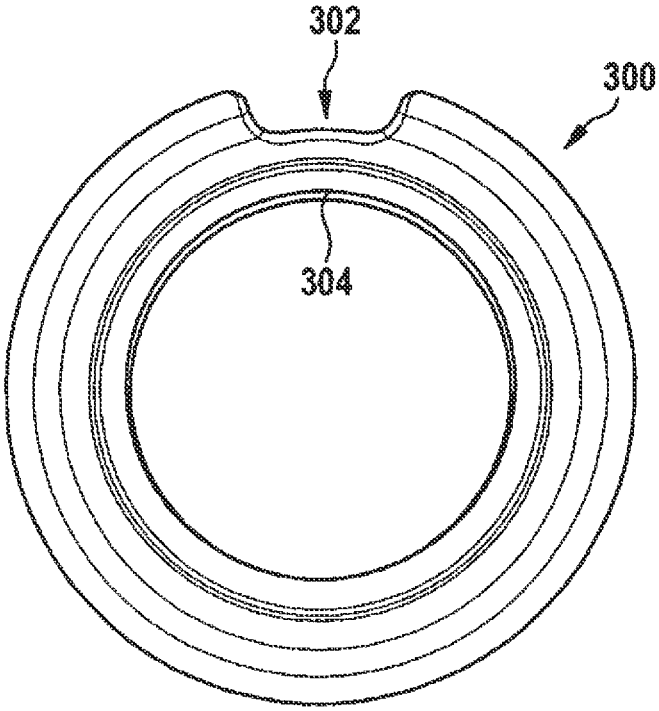
Figure 6:
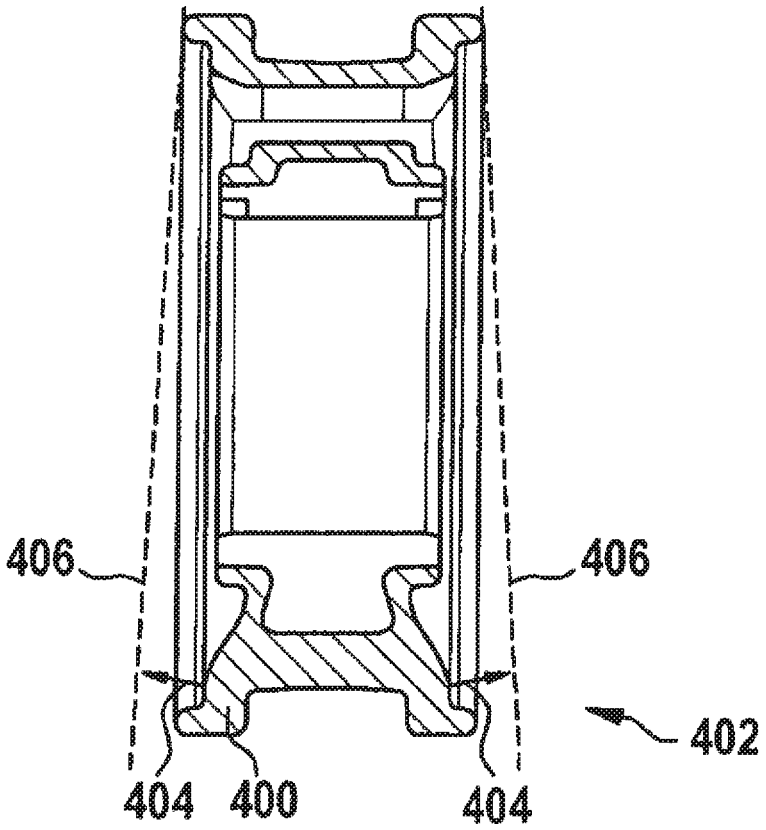
Figure 7:
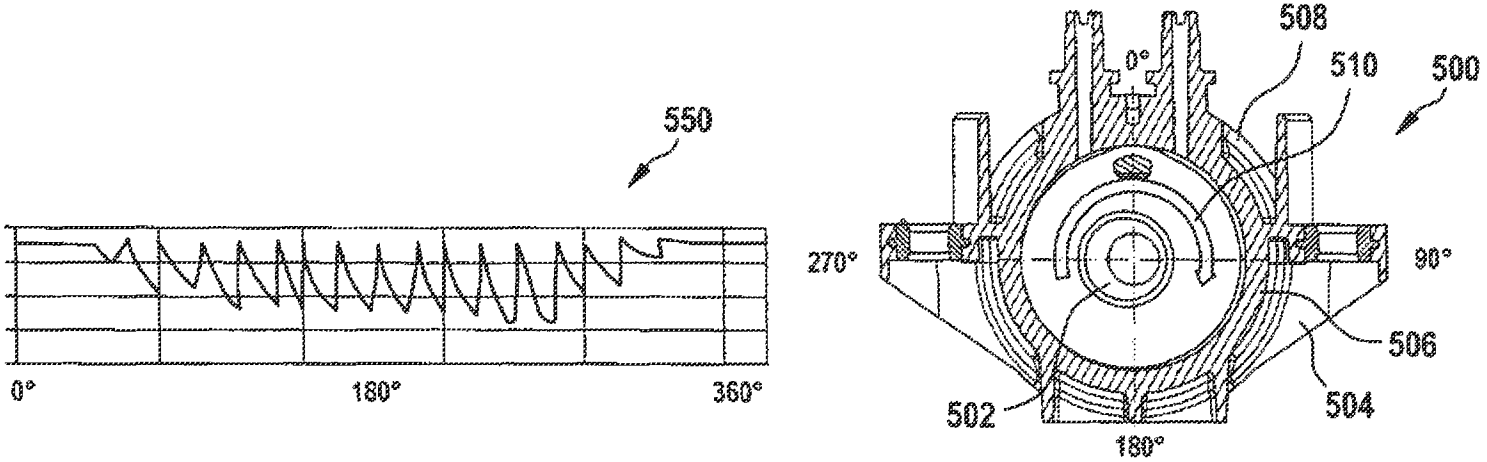

The invention is schematically shown in the drawings based on embodiments, schematically and extensively described with reference to the drawings. The figures show as follows:

FIG. 1: a sectional view of a pump device;

FIG. 2: a side view of the pump device of FIG. 1;

FIG. 3: a sectional view of the pump device of FIG. 1;

FIG. 4: a cross-section of a hydraulic enclosure with a recess;

FIG. 5: an embodiment of a pump ring carrier;

FIG. 6: an embodiment of a pump ring in a sectional view;

FIG. 7: a pump arrangement, in order to clarify different positions of the eccentric.

FIGS. 1 through 3 are shown primarily in order to explain the operation of a pump device of the type described here without addressing the special features of the pump device proposed here in detail.

FIG. 1 shows a sectional view of a pump device, referred to in general with reference number 10, and embodied here as an orbital pump. The illustration shows a hydraulic enclosure 12, a pump ring 14, a pump ring carrier 16, an eccentric 18, a shaft 20, a drive 140, a first bearing 110, a second bearing 118, a socket 112 that may also be described as a ring 112, a clamping member 114 that may also be described as a separating chamber pin, an eccentric bearing 116, and a sealing ring 120 that may also be described as a sealing disk 120.

The first bearing 110 in this embodiment is mounted as a floating bearing, and the second bearing 118 is mounted as a fixed bearing. This provides for quality bearing.

By way of eccentric bearing 116, a needle bearing may be used. This bearing has a limited radial extension. Other bearing types are conceivable as well, for instance rolling bearings. The eccentric bearing 116 allows for a low-friction transfer of forces between the rotating eccentric 18 and the torque-proof pump ring 14 or pump ring carrier 16.

The hydraulic enclosure 12 comprises an annular section 22 as well as a first lateral section 24 that may also be described as a pump cover, and a second lateral section 26 that may also be described as a motor flange or as a drive flange. The two lateral sections 24, 26 are arranged opposite each other. The pump ring 14 is located at least partially between the two lateral sections 24, 26 of the hydraulic enclosure 12. The annular section 22 has a first collar 74 and a second collar 75.

The drive 140 has a stator arrangement 145 as well as a rotor arrangement 146. The drive 140 partially attached to a tubular area 170 of the second lateral section 26.

The pump enclosure 12 has a locking pin 27, designed to snap into place when the clamping member 114 is inserted into the pump enclosure 12 and to axially ensure the clamping member 114. The introduction of the clamping member 114 may take place prior to the assembly of the drive 140.

The pump ring 14 is deformable and may be made out of an elastomeric material or of another deformable material.

FIG. 2 shows a side view of the pump device 10 of FIG. 1.

FIG. 3 shows a section across the pump device 10, seen along section line III-III in FIG. 2. A first connector 51 and a second connector 52 are provided, which connectors 51, 52 are in fluid communication with a pump chamber 57, which is formed between the annular section 22 of the hydraulic enclosure and a running surface 46 of the pump ring, and which in the illustration of FIG. 3 extends annularly and clockwise from the first connector 51 to the second connector 52. In the section extending counterclockwise from the first connector 51 to the second connector 52, the pump chamber 57 is deactivated by the clamping member 114 in that the clamping member 114 statically presses the running surface 46 of the pump ring 14 against the annular section 22 of the hydraulic enclosure 12, thus preventing a flow of fluid through this section, or at least powerfully reducing it. The region in which the clamping member 114 presses the running surface 46 of the pump ring 14 against the annular section 22 will also be referred to hereinafter as the clamping member region 45.

The illustration of the interior of the hydraulic enclosure 12 is schematic and exaggerates the deformation of the pump ring 14 in order to clarify the principle.

The functionality of the orbital pump is described below based on FIG. 1 and FIG. 3.

The eccentric 18 is supported on the shaft 20 and is driven by it. The drive 140, typically a motor or an electric motor, serves in turn for driving the shaft 20. According to one embodiment, a controllable drive 140 is provided by way of drive 140.

The shaft 20 is rotated around its longitudinal axis 21, which defines an axial direction of the pump device 10. The eccentric 18 is therefore also moved into a rotation around the longitudinal axis of the shaft 20. This movement of the eccentric 18 is transmitted to the pump ring 14 via the bearing 116 and via the pump ring carrier 16. The pump ring carrier 16 and the pump ring 14 are connected in a torque-proof connection relative to the hydraulic enclosure 12, but they are moved locally toward or away from the annular section 22, depending on the rotating position of the eccentric 18. FIG. 3 shows the eccentric 18 in a direction marked by an arrow 19, pointing in the shown example at 9 o'clock, in other words, the region of the eccentric 18 with the greatest radial extension shows in the direction of the arrow 19. This causes the pump ring 14 to be moved in this direction 19 and to be pressed against the annular section 22 in the region 58. This causes the pump channel 57 to be reduced or fully blocked in region 58.

When the eccentric rotates clockwise, the location 58, at which the pump ring 14 is pressed against the annular section 22, moves clockwise as well, such that the fluid in the pump chamber 57 is pumped or transported clockwise from the first connector 51 to the second connector 52. A fluid bypass via which the fluid moves clockwise from the second connector 52 to the first connector 51 is prevented by the clamping member 114 or by another interruption of the pump chamber 57 in this region.

The pump device 10 also functions in the opposite direction as a result of a reversal of the rotational directions of the eccentric 18.

FIG. 4 shows a section of a hydraulic enclosure 200 with a recess 202 formed in a convex region 204 of the hydraulic enclosure 200. Via this recess 202 in convex region 204 in the region of the clamping member and the resulting rigidity change (i.e., decrease in ring rigidity via the smaller axial pressing action of the pump ring), the park position detection of the eccentric improves in the 0° position. This recess may be provided as a graded and/or as a continuous transition.

FIG. 5 shows a top view of an embodiment of a pump ring carrier, referred to in general with reference number 300. The figures in the illustration are only exemplary, and are in no way restrictive. In this pump ring carrier 300, a recess is provided circumferentially in the side wall, which is not shown in this illustration, and in which the pump ring (not shown) is at least partially provided.

The illustration further shows a pump ring carrier recess 302 in the circumferential region of the pump ring carrier 300, into which the clamping member (not shown) is to be inserted. The pump ring 300 further has an enlarged diameter 304 on the interior side facing the eccentric (not shown) in the angular region of the clamping member, which may be in the range of 1/10 mm, resulting in an out-of-roundness. The out-of-roundness in the direction of the clamping member leads to a lower mechanical strain in that direction as compared to other directions. As a result, the eccentric can park more easily in the 0° position.

FIG. 6 shows a sectional view of an embodiment of a pump ring, referred to in general with reference number 400. In one region 402, it features a mound, marked by the arrows 404 and the dotted lines 406. This region, which may comprise the entire extensive region of the pump ring 400 except for the clamping member region, therefore has an increased strength. This results in turn in a reduced strength of the pump ring in the region that is in the clamping member region in the installed state of the pump ring 400. This results in a reduced axial pressing action of the built-in pump ring 400 in the clamping member region.

Due to the asymmetrical mound of the pump ring 400, there is therefore a lower axial pressing action in the region of the clamping member than in the remaining part of the pump ring 400. With the lower axial pressing action, the detection of the eccentric improves in direction 0°.

The respective listed measures a), b), c) individually or in any combination, favor a rotating position of the eccentric in the zero position, that is in the direction of the clamping member 114, since in this region, the pump ring 14 can be easily moved by distance 48 towards the clamping member 114. The zero position as a parking position is advantageous, since in the other positions there is an increased risk that the pressure difference between outlet and intake exercises a moment on the eccentric that leads to a rotation of the eccentric 18 when it is not held by the shaft 20 (cf. FIG. 1).

FIG. 7 shows a schematic view of a pump device 500, of which an eccentric 502, a pump ring carrier 504, a pump ring 506, and a hydraulic enclosure 508 are shown. An arrow 510 shows the rotation of the eccentric. The illustration shows different rotating positions of the eccentric 502, specifically 0°, 90°, 180°, and 270°. These are possible rotating positions, and therefore also parking positions of the eccentric 502. The stated measures are intended to reach a parking position of the eccentric 502 of 0°.

On the left side of the illustration, a graph 550 is shown, the X-axis of which shows the rotation angle of the eccentric 502, and the Y-axis of which shows the pressure. The graph 550 therefore clarifies the development of the pressure as a function of the rotation angle of the eccentric 502.

Naturally, the present invention allows for many possible variations and modifications. on-installed state of the pump ring (14), provides in one region at least a reduced strength of the pump ring (14), said region being in the clamping member region in the installed state of the pump ring (14), resulting in a reduced axial pressing action of the pump ring (14) in the clamping member region.

The invention claimed is:

1. A pump device (10, 500) for pumping a fluid, having a hydraulic enclosure (12, 200, 508) that comprises an annular section (22), a pump ring (14, 400, 506) that is deformable and defines an annular pump chamber (57), a pump ring carrier (16, 300, 504) that is solidly connected to the pump ring (14), a first connector (51) and a second connector (52), which first connector (51) and which second connector (52) are in fluid communication with the pump chamber (57), an eccentric (18, 502), which must be driven by a shaft (20) defining an axial and a radial direction such that the eccentric (18, 502) is rotatable relative to the hydraulic enclosure (12, 200, 508), wherein the eccentric (18, 502) is arranged in the pump device (10, 500) in such a manner that the eccentric (18, 502) deforms the pump ring (14, 400, 506) as a function of a current rotating position of the eccentric (18, 502) in such a manner that the pump ring (14, 400, 506) presses against the annular section (22) at least in certain regions in order to convey the fluid along the pump chamber (57) from the first connector (51) to the second connector (52), depending on the current rotating position of the eccentric (18, 502), by rotating the eccentric (18, 502), a clamping member (114), designed to statically press the pump ring (14, 400, 506) against the annular section (22) of the hydraulic enclosure (12, 200, 508) in a clamping member region (45), wherein the pump device (10, 500) is adapted such that by way of at least one measure, a parking position of the eccentric (18, 502) is affected such that a preferred parking position of the eccentric is achieved in the region of the clamping member (114), the measure being:

a) at least one recess (202) in the hydraulic enclosure (12, 200, 508) is provided in a convex area (204) of the hydraulic enclosure (12, 200, 508), the at least one recess (202) being on an inner radial edge of the convex area (204) and disposed adjacent an outer radial edge of the pump ring (14) that is radially outside the clamping member (114), the at least one recess (202) extending in the axial direction defined by the longitudinal axis of the shaft (20) and configured to accommodate at least part of the pump ring (14, 400, 506) therein along the axial direction in the clamping member region (45) to decrease rigidity and axial pressing action of the pump ring (14, 400, 506) in the clamping member region (45).

2. A pump device according to claim 1, in which measure a) provides for the at least one recess (202) in the hydraulic enclosure (12, 200, 508) to be graded.

3. A pump device according to claim 1, in which measure a) provides for the at least one recess (202) in the hydraulic enclosure (12, 200, 508) to be continuous.

4. A pump device according to claim 1, in which measure a) provides that two recesses (202) are provided, and are provided opposite in the axial direction in the hydraulic enclosure (12, 200, 508).

5. A pump device according to claim 1, wherein the at least one measure further comprises a measure b), in which the measure b) provides that the pump ring carrier (16, 300, 504) features an enlarged diameter on its outer side facing the eccentric (18, 502) in an angular region of the clamping member (114).

6. A pump device according to claim 1, wherein the at least one measure further comprises a measure c), in which the measure c) provides that the pump ring (14, 400, 506) is embodied such that it features an asymmetrical mound in its non-installed state.

7. A pump device according to claim 1, in which the clamping member (114) is designed to statically press at least a portion of the pump ring (14, 400, 506) against the annular section (22) in the clamping member region (45) between the first connector (51) and the second connector (52), and as a result to reduce or prevent a flow of fluid between the first connector (51) and the second connector (52) via the clamping member region (45).

8. A pump ring for a pump device (10, 500) according to claim 1, in which the pump ring (14, 400, 506) provides for a reduced strength of the pump ring (14, 400, 506) in one region, said region being in the clamping member region (45) in the installed state of the pump ring (14, 400, 506), resulting in a reduced axial pressing action of the pump ring (14, 400, 506) in the clamping member region (45).

9. A pump ring according to claim 8, featuring an asymmetrical mound.

10. A pump device according to claim 1, wherein the at least one measure further comprises a measure c), in which the measure c) provides a geometric configuration of the pump ring (14, 400, 506) which provides at least for a reduced strength of the pump ring (14, 400, 506) in one region in the non-installed state of the pump ring (14, 400, 506), this region being in the clamping member region (45) in the installed state of the pump ring (14, 400, 506), resulting in a reduced axial pressing action of the pump ring (14, 400, 506) in the clamping member region (45), the geometric configuration comprising the pump ring having, in the non-installed state, an asymmetrical mound in a region thereof with greater height in the axial direction than the height of the pump ring (14, 400, 506) in the clamping member region (45) to provide the pump ring with increased strength in the region of the asymmetrical mound.

11. A pump device according to claim 1, wherein a plurality of measures are used to adapt the pump device (10, 500) such that the preferred parking position of the eccentric is achieved in the region of the clamping member (114), the plurality of measures comprising at least one of a measure b) and a measure c), combined with the measure a) wherein:

the measure b) comprises a geometry of the pump ring carrier (16, 300, 504) that is such that the pump ring carrier (16, 300, 504) features an enlarged diameter (304) on its interior side facing the eccentric (18, 502) in an angular region of the clamping member (114), and the measure c) corresponds to the geometric configuration of the pump ring (14, 400, 506) according to claim 1 that provides at least for a reduced strength of the pump ring (14, 400, 506) in one region in the non-installed state of the pump ring (14, 400, 506), this region being in the clamping member region (45) in the installed state of the pump ring (14, 400, 506), resulting in a reduced axial pressing action of the pump ring (14, 400, 506) in the clamping member region (45)), the geometric configuration comprising the pump ring having, in the non-installed state, an asymmetrical mound in a region thereof with greater width in the axial direction than the width of the pump ring (14, 400, 506) in the clamping member region (45) to provide the pump ring with increased strength in the region of the asymmetrical mound.

12. A pump device according to claim 11, wherein the region of the asymmetrical mound comprises the entire extensive region of the pump ring except for the clamping member region.

* * * * *